US005787911A

United States Patent [19]

Jacobus et al.

[11] Patent Number: 5,787,911

[45] Date of Patent: Aug. 4, 1998

[54] WIRELESS PLASTIC UPPER DISH RACK

[75] Inventors: Dwight William Jacobus; John Leo Preher, both of Louisville, Ky.

[73] Assignee: General Electric Company, Louisville, Ky.

[21] Appl. No.: 755,974

[22] Filed: Nov. 25, 1996

[51] Int. Cl.[6] ..... A47L 15/50

[52] U.S. Cl. ..... 134/201; 312/334.8

[58] Field of Search ..... 134/201; 384/19, 384/20, 21, 22, 23; 312/330.1, 334.8, 334.12

[56] References Cited

U.S. PATENT DOCUMENTS

| | | | |
|---|---|---|---|
| 2,757,051 | 7/1956 | Wilmer et al. . | |
| 3,050,348 | 8/1962 | Pipe | 384/19 |
| 3,059,986 | 10/1962 | Miller, Jr. | 312/334.8 |
| 3,096,125 | 7/1963 | Kendt | 384/19 |
| 3,649,090 | 3/1972 | Dutot . | |
| 3,927,918 | 12/1975 | Dobbratz . | |
| 4,437,715 | 3/1984 | Jenkins | 312/330.1 X |
| 5,345,959 | 9/1994 | Matteson | 384/22 X |
| 5,403,097 | 4/1995 | Woof . | |
| 5,595,200 | 1/1997 | Favaro | 134/201 |

*Primary Examiner*—Philip R. Coe
*Attorney, Agent, or Firm*—H. Neil Houser

[57] ABSTRACT

A plastic molded, upper dishwasher rack and support assemblies are described. In one embodiment, the upper rack is supported by first and second upper rack support assemblies, and each support assembly includes an elongate slide member and first and second roller assemblies secured to respective sidewalls of the tub. Each elongate slide member includes a channel, and upper and lower flanges. The rollers are located within the channels so that the slide member is movable relative to first and second rollers. Front and rear caps are secured to a front end and a back end, respectively, of each slide member. The flanges and caps facilitate retaining, or trapping, the rollers within the channels. In addition, the front caps have stop members extending inwardly towards the upper rack and cooperate with the upper rack to limit the extent to which the upper rack can be withdrawn from tub. The upper rack includes a plurality of stringers and rails arranged in a basket-like configuration including a bottom portion and oppositely disposed generally parallel and upwardly extending first and second side portions. The upper rack further includes front and back wall portions extending upwardly from bottom portion and interconnecting ends of the first and second side portions. A first rim is formed along the first side portion and is configured to receive a portion of the elongate slide member of the first support assembly. A second rim is formed along the second side portion and is configured to receive a portion of the elongate slide member of the second support assembly. Stop members extend from the side portions of the upper rack, and the stop members cooperate with the front cap stop members to limit the extent to which the upper rack can be withdrawn from the tub.

20 Claims, 1 Drawing Sheet

WIRELESS PLASTIC UPPER DISH RACK

FIELD OF THE INVENTION

This invention relates generally to dishwashing machines and, more particularly, to an upper dish rack for a dishwashing machine.

BACKGROUND OF THE INVENTION

Dishwashing machines typically include a cabinet having an access door hinged at its lower end to pivot on a horizontal axis and open outwardly from the cabinet. The cabinet includes a wash chamber, and lower and upper dishwashing racks are vertically mounted within the wash chamber. The racks can be slidably withdrawn outwardly through an access opening.

Known upper racks for dishwashing machines are constructed using spaced apart wire rod members. The wire rod members form a basket-like configuration and are welded at their points of intersection. After welding, the rod members are plastic coated for improved appearance and durability.

Although the wire rod upper racks have been used successfully for many years, it would be desirable to reduce the cost and complexity of assembling the upper racks. Of course, in reducing the cost and assembly complexity of the upper racks, the functionality of the upper rack should not be adversely affected.

SUMMARY OF THE INVENTION

These and other objects may be attained in a plastic molded upper dishwasher rack configured to be vertically positioned within a dishwashing machine wash chamber and slidable relative to the machine tub so that the upper rack can be slidably withdrawn outwardly through the machine access opening and retracted into the wash chamber. In one embodiment, the upper rack is supported by first and second upper rack support assemblies, and each support assemblies includes an elongate slide member and first and second roller assemblies secured to respective sidewalls of the tub. Each roller assembly includes a roller secured to a first end of an axle and rotatable relative to axle, and a threaded stud extending from a second end of axle. The threaded stud is inserted into an opening in the sidewalls of the tub and is threadedly engaged to the sidewall.

Each elongate slide member includes a channel, and upper and lower flanges. The rollers are located within the channels so that the slide member is movable relative to first and second rollers. Front and rear caps are secured to a front end and a back end, respectively, of each slide member. The flanges and caps facilitate retaining, or trapping, the rollers within the channels. In addition, the front caps have stop members extending inwardly towards the upper rack and cooperate with the upper rack to limit the extent to which the upper rack can be withdrawn from tub.

The upper rack includes a plurality of stringers and rails arranged in a basket-like configuration including a bottom portion and oppositely disposed generally parallel and upwardly extending first and second side portions. The upper rack further includes front and back wall portions extending upwardly from the rack bottom portion and interconnecting ends of the first and second side portions. A first rim is formed along the first side portion and is configured to receive a portion of the elongate slide member of the first support assembly. A second rim is formed along the second side portion and is configured to receive a portion of the elongate slide member of the second support assembly. Stop members extend from the side portions of the upper rack, and the stop members cooperate with the front cap stop members to limit the extent to which the upper rack can be withdrawn from the tub.

In operation, and when the upper rack is fully retracted within the tub, the rack is supported substantially along its entire length by the slide members. By providing such support along the entire rack length, the rack is fully supported when it is hot, which facilitates the use of low cost plastic for molding the rack. Molding rack from low cost plastic facilitates reducing the cost of the dishwashing machine, including both material and assembly costs.

To withdraw the rack outwardly through the access opening, the rack is pulled and the rack and slide members move together on the rollers. When the rear caps of the slide members abut against the rear rollers, the rack slides on the slide members. The rack is fully withdrawn when the rack stop members abut against the front cap stop members.

To retract the rack into the wash chamber from the fully withdrawn position as described above, the rack is pushed inward toward the wash chamber so that the rack slides on the slide members inward through the access opening. When the rack abuts against the front caps of the slide members, the rack and slide members then roll on the rollers until the rack is fully located within the wash chamber so that the door can be closed.

The present plastic upper dish rack is believed to be lower in cost and complexity than the known wire rod upper racks. For example, the plastic upper dish rack can be molded from a low cost plastic and the time consuming and tedious operation of constructing an upper rack using wire rod members welded at their points of intersection can be eliminated. In addition, the plastic upper dish rack does not adversely affect dishwashing machine operations.

DETAILED DESCRIPTION OF THE DRAWINGS

Figure 1:
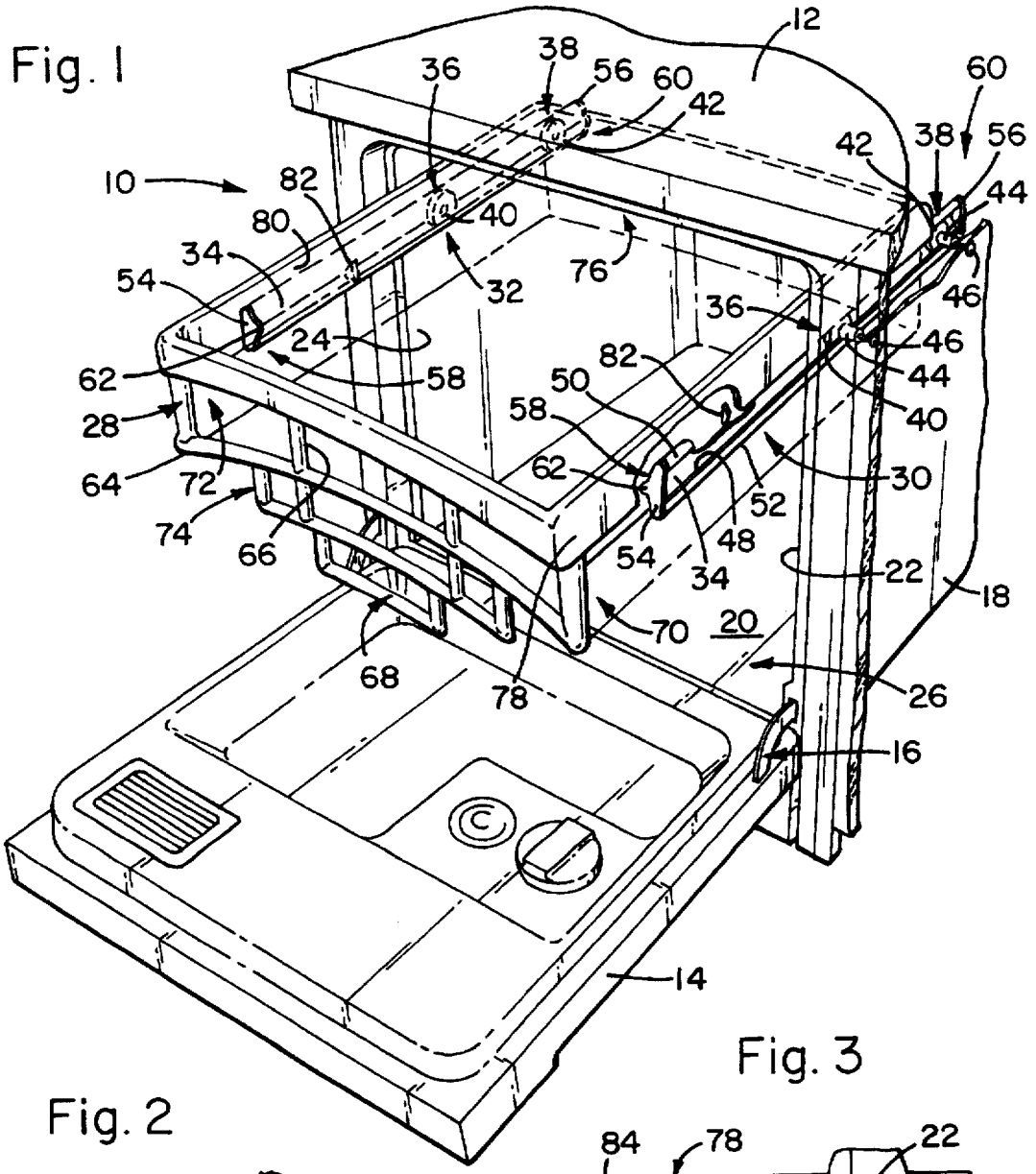
FIG. 1 is a side elevational view of a front loading dishwashing machine having a portion of the cabinet side wall cut away to show an upper rack and support structure within the wash chamber, in accordance with one embodiment of the present invention.

FIG. 1 is a side elevational view of a front loading dishwashing machine 10. Machine 10 includes a cabinet 12 having an access door 14 hinged at its lower end 16 to pivot on a horizontal axis and open outwardly from cabinet 12. A tub 18 is positioned within 12 cabinet and forms a wash chamber 20. Tub 18 includes first and second sidewalls 22 and 24 respectively, and an access opening 26. Access door 14 is hinged to swing downwardly away from access opening 26. Dishwasher 10 may, for example, be model number GSD-900X-72BA, commercially available from General Electric Company, Appliance Park, Louisville, Ky. 40225, modified to include an upper rack 28 and first and second upper rack support assemblies, 30 and 32 respectively, which are described below in more detail.

Specifically, machine 10 further includes upper rack 28 vertically positioned within wash chamber 20 and slidable relative to tub 18 so that upper rack 28 can be slidably withdrawn outwardly through access opening 26 and retracted into wash chamber 20. Upper rack 28 is supported by first and second upper rack support assemblies 30 and 32, respectively, and support assemblies 30 and 32 each include an elongate slide member 34 and first and second roller assemblies 36 and 38 secured to respective sidewalls 22 and 24 of tub 18. First and second roller assemblies 36 and 38 include rollers 40 and 42, respectively. Each roller 40 and 42 is secured to a first end of an axle 44 and rotatable relative to axle 44, and a threaded stud 46 extending from a second end of axle 44. Threaded studs 46 are inserted into openings (not shown) in sidewalls 22 and 24 of tub 18 and are threadedly engaged to sidewalls 22 and 24.

Each elongate slide member 34 includes a channel 48, and upper and lower flanges 50 and 52. First and second rollers 40 and 42 are located within channel 48 so that slide member 34 is movable relative to first and second rollers 40 and 42. Front and rear caps 54 and 56 are secured to a front end 58 and a back end 60, respectively, of each slide member 34. Flanges 50 and 52 and caps 54 and 56 facilitate retaining, or trapping, rollers 40 and 42 within channels 48. In addition, front caps 54 and 56 have stop members 62 (i.e., protrusions illustrated as tabs) extending inwardly towards upper rack 28 and, as described hereinafter in more detail, cooperate with upper rack 28 to limit the extent to which upper rack 28 can be withdrawn from tub 18.

Upper rack 28 includes a plurality of stringers 64 and rails 66 arranged in a basket-like configuration including a bottom portion 68 and oppositely disposed generally parallel and upwardly extending first and second side portions 70 and 72. Upper rack 28 further includes front and back wall portions 74 and 76 respectively extending upwardly from bottom portion 68 and interconnecting ends of first and second side portions 70 and 72.

A first rim 78 is formed along first side portion 70 and is configured to receive a portion of elongate slide member 34 of first support assembly 30. A second rim 80 is formed along second side portion 72 and is configured to receive a portion of elongate slide member 34 of second support assembly 32. Although first and second rims 78 and 80 are shown in FIG. 1 as being located at an upper section of rack, it should be understood that rims 78 and 80 could be located at other locations, or elevations, along respective first and second side portions 70 and 72. Stop members 82 (i.e., protrusions) extend from side portions 70 and 72 of upper rack 28, and stop members 82 cooperate with front cap stop members 62 to limit the extent to which upper rack 28 can be withdrawn from tub 18.

Figure 2:
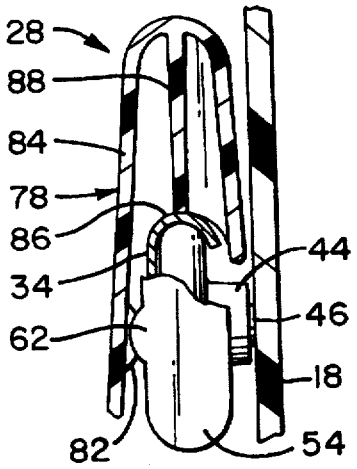
FIG. 2 is a cross-section view through a portion of the upper rack, slide and tub shown in FIG. 1.

More particularly, and referring to FIG. 2 which is a cross-section view through a portion of upper rack 28, slide 34 and tub 18, stop member 82 of rack 28 abuts against front cap stop member 62 when rack is slid outward from tub 18 on slide member 34 to a predetermined distance. In this manner, stop members 82 cooperate with front cap stop members 62 and limit the extent to which upper rack 28 can be withdrawn from tub 18. As also shown in FIG. 2, rim 78 includes an outer shroud 84, and inner slide surface 86, and a support rib 88 extends from and between inner slide surface 86 and outer shroud 84. Support rib 88 provides strength and rigidity for both outer shroud 84 and inner slide surface 86.

Figure 3:
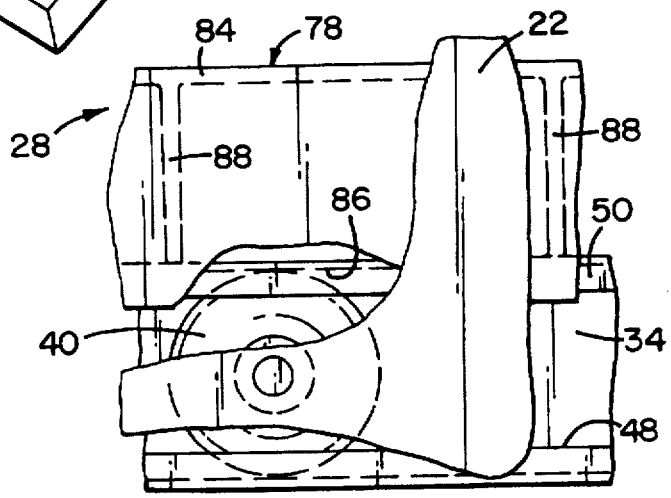
FIG. 3 is a side view of the upper rack, slide and a roller with a portion of the tub side wall cut away.

As shown in FIG. 3, which is a side view of upper rack 28, slide member 34 and roller 40 with a portion of tub sidewall 22 cut away, a plurality of ribs 88 are provided in rim 78 to provide such strength and rigidity for outer shroud 84 and inner slide surface 86. Roller 40 is positioned within channel 48 and as slide member 34 is moved relative to roller 40, roller 40 rotates to reduce the friction between roller and slide member 34. Further, rim 78 slides on slide member upper flange 50.

In operation, and when upper rack 28 is fully retracted within tub 18, rack 28 is supported substantially along its entire length by slide members 34. By providing such support along the entire rack length, rack 28 is fully supported when it is hot (e.g., rack 28 is hot during and at the end of a washing operation), which facilitates the use of low cost plastic for molding rack 28, as described below in more detail. Molding rack 28 from low cost plastic facilitates reducing the cost of machine, including both material and assembly costs.

To withdraw rack 28 outwardly through access opening 26, rack 28 is pulled, and rack 28 and slide members 34 move together on rollers 40 and 42. When rear caps 56 abut against rollers 42, rack 28 slides on slide members 34. Rack 28 is fully withdrawn when the rack stop members 82 abut against front cap stop members 62.

To retract rack 28 into wash chamber 20 from the fully withdrawn position as described above, rack 28 is pushed inward toward wash chamber 20 so that rack 28 slides on slide members 34 inward through access opening 26. When rack 28 abuts against front caps 54 of slide members 34, rack 28 and slide members 34 then roll on rollers 40 and 42 until rack 28 is fully located within wash chamber 20 so that door 14 can be closed.

The above described operation of rack 28 is achieved by properly selecting materials of construction for rack 28, slide member 34, and rollers 40 and 42. Specifically, and in one embodiment, rack 28 is molded from a plastic such as glass filled polypropelyne. Rollers 40 and 42 are nylon, and slide members 34 are stainless steel. These materials have coefficients of friction which enable the above described operation. Of course, other materials and combinations of materials can be used to achieve the desired operation.

The plastic upper dish rack described above is believed to be lower in cost and complexity than the known wire rod upper racks. For example, the plastic upper dish rack can be molded from a low cost plastic and the time consuming and tedious operation of constructing an upper rack using wire rod members welded at their points of intersection can be eliminated. In addition, the plastic upper dish rack does not adversely affect dishwashing machine operations.

From the preceding description of the present invention, it is evident that the objects of the invention are attained. Although the invention has been described and illustrated in detail, it is to be clearly understood that the same is intended by way of illustration and example only and is not be taken by way of limitation. Accordingly, the spirit and scope of the invention are to be limited only by the terms of the appended claims.

What is claimed is:

1. An upper rack for a dishwasher including a tub having first and second sidewalls, first and second upper rack support assemblies secured to the respective first and second sidewalls, the first and second upper rack support assemblies each including an elongate slide member, said upper rack comprising:

a plurality of stringers and rails arranged in a basket-like configuration including a bottom portion and oppositely disposed generally parallel and upwardly extending first and second side portions;

a first rim formed by said first side portion and configured to receive a portion of the elongate slide member of the first support assembly; and a second rim formed by said second side portion and configured to receive a portion of the elongate slide member of the second support assembly.

2. An upper rack in accordance with claim 1 wherein said rack is plastic.

3. An upper rack in accordance with claim 2 wherein said plastic is a glass filled polypropelyne.

4. An upper rack in accordance with claim 1 wherein said upper rack further comprises front and back wall portions extending upwardly from said bottom portion and interconnecting ends of said first and second side portions.

5. An upper rack in accordance with claim 1 wherein a first stop member extends from said first side portion.

6. An upper rack in accordance with claim 5 wherein said first stop member comprises a protrusion.

7. An upper rack in accordance with claim 5 wherein the first slide member includes a protrusion, and said first stop member cooperates with the first slide member protrusion to limit the extent to which said upper rack can be withdrawn from the tub.

8. An upper rack in accordance with claim 5 wherein a second stop member extends from said second side portion.

9. An upper rack in accordance with claim 8 wherein the second slide member includes a protrusion, and said second stop member cooperates with the second slide member protrusion to limit the extent to which said upper rack can be withdrawn from the tub.

10. A dishwasher comprising:

a cabinet having an access door hinged at its lower end to pivot on a horizontal axis and open outwardly from said cabinet;

a tub positioned within said cabinet and forming a wash chamber, said tub including first and second sidewalls and having an access opening, said access door hinged to swing downwardly away from said access opening;

first and second upper rack support assemblies secured to said first and second sidewalls, respectively, of said tub, said first and second upper rack support assemblies each including an elongate slide member; and an upper rack vertically positioned within said wash chamber and slidable relative to said tub so that said upper rack can be slidably withdrawn outwardly through said access opening and retracted into said chamber, said upper rack comprising a plurality of stringers and rails arranged in a basket-like configuration including a bottom portion and oppositely disposed generally parallel and upwardly extending first and second side portions, a first rim formed by said first side portion and configured to receive a portion of said elongate slide member of said first support assembly, and a second rim formed by said second side portion and configured to receive a portion of said elongate slide member of said second support assembly.

11. A dishwasher in accordance with claim 10 wherein said first upper rack support assembly comprises first and second roller assemblies secured to said first sidewall of said tub and comprising respective first and second rollers, said elongate slide member of said first support assembly comprising a channel, said first and second rollers located within said channel so that said slide member is movable relative to said first and second rollers.

12. A dishwasher in accordance with claim 11 wherein a front cap is secured to a front end of said slide member of said first upper rack support assembly, said front cap having a stop member extending inwardly towards said upper rack.

13. A dishwasher in accordance with claim 12 wherein a stop member extends from said first side portion of said upper rack, said first side portion stop member cooperating with said front cap stop member of said first support assembly slide member to limit the extent to which said upper rack can be withdrawn from said tub.

14. A dishwasher in accordance with claim 11 wherein said plastic is a glass filled polypropelyne.

15. A dishwasher in accordance with claim 10 wherein said second upper rack support assembly comprises first and second roller assemblies secured to said second sidewall of said tub and comprising respective first and second rollers, said elongate slide member of said second support assembly comprising a channel, said first and second rollers located within said channel so that said slide member is movable relative to said first and second rollers.

16. A dishwasher in accordance with claim 15 wherein a front cap is secured to a front end of said slide member of said second upper rack support assembly, said front cap having a stop member extending inwardly towards said upper rack.

17. A dishwasher in accordance with claim 16 wherein a stop member extends from said second side portion of said upper rack, said second side portion stop member cooperating with said front cap stop member of said second support assembly slide member to limit the extent to which said upper rack can be withdrawn from said tub.

18. A dishwasher in accordance with claim 10 wherein said upper rack is plastic.

19. A dishwasher in accordance with claim 10 wherein said upper rack further comprises front and back wall portions extending upwardly from said bottom portion and interconnecting ends of said first and second side portions.

20. A dishwasher in accordance with claim 10 wherein said first and second upper rack support assemblies each comprise a plurality of roller assemblies, each of said roller assemblies comprising a roller secured to a first end of an axle and rotatable relative to said axle, and a threaded stud extending from a second end of said axle.

* * * * *